US007848693B2

(12) United States Patent
Park et al.

(10) Patent No.: US 7,848,693 B2
(45) Date of Patent: Dec. 7, 2010

(54) ENDLESS BELT TYPE FUSING DEVICE AND IMAGE FORMING APPARATUS EMPLOYING THE SAME

(75) Inventors: Eun-sang Park, Suwon-si (KR); Woo-chul Jung, Yongin-si (KR); Kyung-shig Chung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 795 days.

(21) Appl. No.: 11/771,466

(22) Filed: Jun. 29, 2007

(65) Prior Publication Data

US 2008/0138130 A1 Jun. 12, 2008

(30) Foreign Application Priority Data

Dec. 7, 2006 (KR) ..... 10-2006-0123721

(51) Int. Cl.
*G03G 15/20* (2006.01)

(52) U.S. Cl. ..... 399/329

(58) Field of Classification Search ..... 399/328, 399/329; 219/216
See application file for complete search history.

(56) References Cited

U.S. PATENT DOCUMENTS

| | | | | |
|---|---|---|---|---|
| 7,421,236 | B2 * | 9/2008 | Jang et al. | 399/328 |
| 7,466,952 | B2 * | 12/2008 | Ito et al. | 399/329 |
| 7,477,858 | B2 * | 1/2009 | Fujii et al. | 399/329 |
| 2006/0245799 | A1 | 11/2006 | Fujiwara | |
| 2007/0025784 | A1 | 2/2007 | Ito et al. | |

FOREIGN PATENT DOCUMENTS

| | | |
|---|---|---|
| CN | 1854941 A | 11/2006 |
| EP | 1 852 750 | 11/2007 |
| JP | 11-307493 | 11/1999 |
| JP | 2004-020641 | 1/2004 |
| JP | 2004-184446 | 7/2004 |
| JP | 2005-234268 | 9/2005 |
| JP | 2006-30354 | 2/2006 |

OTHER PUBLICATIONS

Search Report dated Feb. 6, 2008, issued by the European Patent Office.
Search Report dated Apr. 1, 2008, issued by the European Patent Office.
Office Action issued in Chinese Application No. 2007101635543 on Jul. 10, 2009.

* cited by examiner

*Primary Examiner*—William J Royer
(74) *Attorney, Agent, or Firm*—Staas & Halsey LLP

(57) ABSTRACT

A fusing device that is provided on a printing passage of an image forming apparatus and fuses an image transferred to a print medium, the fusing device including: a heating roller; a pressure roller to press the print medium fed along the printing passage against the heating roller; a separation roller to separate the print medium from the heating roller; a fusing pressure belt that winds around the pressure roller and the separation roller; a first elastic member to pressure the pressure roller towards the heating roller along a first line; and a second elastic member to pressure the separation roller towards the heating roller, wherein the first line passes through a center of the pressure roller and forms an angle towards the separation roller with a second line that passes through a center of the heating roller and the center of the pressure roller.

20 Claims, 4 Drawing Sheets

ENDLESS BELT TYPE FUSING DEVICE AND IMAGE FORMING APPARATUS EMPLOYING THE SAME

CROSS-REFERENCE TO RELATED APPLICATION

This application claims priority from Korean Patent Application No. 2006-123721, filed on Dec. 7, 2006 in the Korean Intellectual Property Office, the disclosure of which is incorporated herein by reference.

BACKGROUND OF THE INVENTION

1. Field of the Invention

Aspects of the present invention relate to a fusing device that fuses an image transferred to a print medium and an image forming apparatus employing the same, and more particularly, to a fusing device of an endless belt type and an image forming apparatus employing the same.

2. Description of the Related Art

In general, an electrophotographic image forming apparatus prints an image by scanning light to a photosensitive medium that is charged with a predetermined electric potential in order to form an electrostatic latent image, developing the image with a toner of a color, and transferring and fusing the image onto a print medium. A fusing device is provided on a printing passage of the image forming apparatus and fuses the toner image transferred to the print medium.

The fusing device is classified into a roller type and a belt type. In the roller type, a toner image is fused by a heating roller and a pressure roller. In the belt type, a contact surface between the print medium and an endless belt is wide as compared to a nip in a fusing device of the roller type. Accordingly, the fusing device of the belt type does not require an external diameter of the heating roller to be enlarged in order to increase the contact surface. Thus, a configuration of the fusing device becomes compact. Also, as the contact surface is relatively wide in the fusing device of the belt type as compared with that of the roller type, a fusing performance is relatively better. Also, a warm-up time is reduced and an image can be fused during high-speed printing.

FIG. 1 is a schematic cross-sectional view of a conventional fusing device of an endless belt type. Referring to FIG. 1, a conventional fusing device includes a heating roller 11, a pressure roller 21, a separation roller 31 that faces the heating roller 11, and a fusing pressure belt 15 that winds around the pressure roller 21 and the separation roller 31.

The pressure roller 21 and the separation roller 31 support the fusing pressure belt 15 such that the fusing pressure belt 15 rotates. Furthermore, the pressure roller 21 and the separation roller 31 allow a portion of the fusing pressure belt 15 to be in contact with the heating roller 11 or a print medium M being fed. The pressure roller 21 is elastically pressured along a line $L_1$ going through the center $O_1$ of the heating roller 11 and the center $A_1$ of the pressure roller 21. Accordingly, the pressure roller 21 is elastically pressured in a perpendicular direction to a surface of the heating roller 11.

The separation roller 31 is elastically pressured along a line $L_2$ going through the center $O_1$ of the heating roller 11 and the center $B_1$ of the separation roller 31. Accordingly, the separation roller 31 is elastically pressured in a perpendicular direction to a surface of the heating roller 11.

The lines $L_1$ and $L_2$ meet at the center $O_1$ of the heating roller 11 as an apex and make a predetermined angle (i.e., the sum of $\theta_1$ and $\theta_2$). Thus, a distance between the center $A_1$ of the pressure roller 21 and the center $B_1$ of the separation roller 31 varies according to an amount of elastic pressure applied to the rollers 21 and 31. Given two optional lines $P_1$ and $P_2$ that go through the center $A_1$ of the pressure roller 21 and the center $B_1$ of the separation roller 31 and are parallel with each other, the line $L_1$ inclines at $\theta_1$ to the line $P_1$ and the line $L_2$ inclines at $\theta_2$ to the line $P_2$.

Here, a variation of the distance between the pressure roller 21 and the separation roller 31 is influenced by a condition of the print medium M that passes between the heating roller 11 and the fusing pressure belt 15. That is, if a relatively thick printing medium M or a plurality of sheets of print media M pass therebetween, the pressure roller 21 and the separation roller 31 move in a direction such that they become farther away from the heating roller 11. Accordingly, the distance between the pressure roller 21 and the separation roller 31 increases. As a result, a pressure applied to the fusing pressure belt 15 increases. Thus, the fusing pressure belt 15 may become deformed or slip, thereby causing an image distortion, an image offset, a print medium jam, and the like.

SUMMARY OF THE INVENTION

Accordingly, aspects of the present invention provide a fusing device that can prevent inferior fusing and a print medium jam by providing a same direction of force by elastic members to elastically press a pressure roller and a separation roller and an image forming apparatus employing the same.

According to an aspect of the present invention, there is provided a fusing device that is provided on a printing passage of an image forming apparatus and fuses an image transferred to a print medium, the fusing device including: a heating roller to be heated by a heat source; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first elastic member to pressure the pressure roller towards the heating roller along a first line; and a second elastic member to pressure the separation roller towards the heating roller, wherein the first line passes through a center of the pressure roller and forms an angle towards the separation roller with a second line that passes through a center of the heating roller and the center of the pressure roller.

According to another aspect of the present invention, there is provided a fusing device that is provided on a printing passage of an image forming apparatus and fuses an image transferred to a print medium, the fusing device including: a heating roller heated by a heat source; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first elastic member to pressure the pressure roller towards the heating roller; and a second elastic member to pressure the separation roller towards the heating roller along a first line, wherein the first line passes through a center of the separation roller and forms an angle towards the pressure roller with a second line that passes through a center of the heating roller and the center of the separation roller.

According to another aspect of the present invention, the fusing device further includes: a first bushing that supports the pressure roller to be rotatable; a second bushing that supports the separation roller to be rotatable; and a frame such that the first elastic member is provided between the first bushing and the frame, and the second elastic member is provided between the second bushing and the frame.

According to another aspect of the present invention, there is provided an image forming apparatus including: a developing unit to develop an image with a toner and form the image; a light scanning unit to scan a beam to the developing unit to form an electrostatic latent image; a transfer unit corresponding to the developing unit to transfer an image formed in the developing unit to a print medium; and a fusing device that is provided on a printing passage and fuses the image transferred to the print medium, the fusing device including: a heating roller to be heated by a heat source; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first pressure member to pressure the pressure roller towards the heating roller along a first line; and a second pressure member to pressure the separation roller towards the heating roller, wherein the first line passes through a center of the pressure roller and forms an angle $\theta_1$ towards the separation roller with a second line that passes through a center of the heating roller and the center of the pressure roller.

According to another aspect of the present invention, there is provided an image forming apparatus including: a developing unit to develop an image with a toner and forms the image; a light scanning unit to scan a beam to the developing unit to form an electrostatic latent image; a transfer unit corresponding to the developing unit to transfer an image formed in the developing unit to a print medium; and a fusing device that is provided on a printing passage and fuses the image transferred to the print medium, the fusing device including: a heating roller heated by a heat source; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first pressure member to pressure the pressure roller towards the heating roller; and a second pressure member to pressure the separation roller towards the heating roller along a first line, wherein the first line passes through a center of the separation roller and forms an angle $\theta_1$ towards the pressure roller with a second line that passes through a center of the heating roller and the center of the separation roller.

According to another aspect of the present invention, there is provided a pressing device that is provided in an image forming apparatus, the pressing device including: a first unit; a first roller facing the first unit; a second roller facing the first unit; a pressure belt that winds around the first roller and the second roller and forms a nip to contact with the first unit; a first pressure member to pressure the first roller towards the first unit along a first line; and a second pressure member to pressure the second roller towards the first unit along a second line, wherein the first line and the second line are roughly parallel with each other.

According to another aspect of the present invention, there is provided a fusing device that is provided on a printing passage of an image forming apparatus and fuses an image transferred to a print medium, the fusing device including: a heating roller to be heated by a heat source; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first pressure member to pressure the pressure roller towards the heating roller along a first line; and a second pressure member to pressure the separation roller towards the heating roller along a second line, wherein the first line and the second line are roughly parallel with each other.

According to another aspect of the present invention, there is provided a method of fusing an image transferred to a print medium in an image forming apparatus, the method including: heating a heating roller; forming a fusing nip to contact the heating roller with a fusing pressure belt that winds around a pressure roller and a separation roller; pressuring the pressure roller along a first line towards the heating roller in order to press the print medium against the heating roller; and pressuring the separation roller along a second line towards the heating roller in order to separate the print medium from the heating roller, wherein the first line and the second line are roughly parallel with each other.

According to another aspect of the present invention, there is provided a fusing device that is provided on a printing passage of an image forming apparatus and fuses an image transferred to a print medium, the fusing device including: a heating roller including a heat source to heat the heating roller; a pressure roller facing the heating roller to press the print medium fed along the printing passage against the heating roller; a separation roller facing the heating roller to separate the print medium from the heating roller after the image is fused on to the print medium; a fusing pressure belt that winds around the pressure roller and the separation roller and forms a fusing nip to contact with the heating roller; a first pressure member to pressure the pressure roller towards the heating roller; and a second pressure member to pressure the separation roller towards the heating roller, wherein for one of the pressure members, a first line passes through a center of the corresponding pressured roller and forms an angle $\theta_1$ towards the other roller with a second line that passes through a center of the heating roller and the center of the corresponding pressured roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
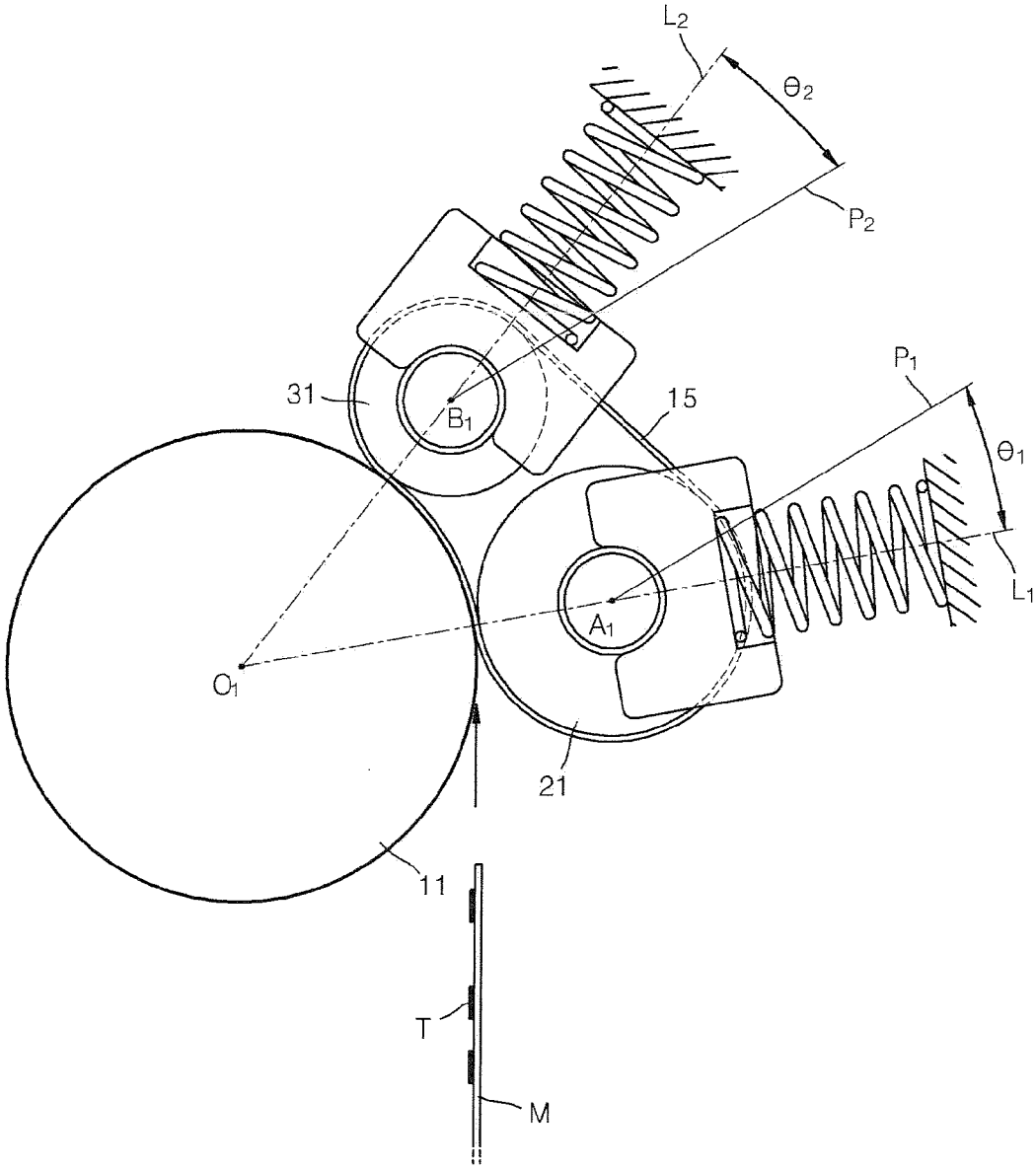
FIG. 1 (RELATED ART)
FIG. 1 is a schematic cross-sectional view of a conventional fusing device.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
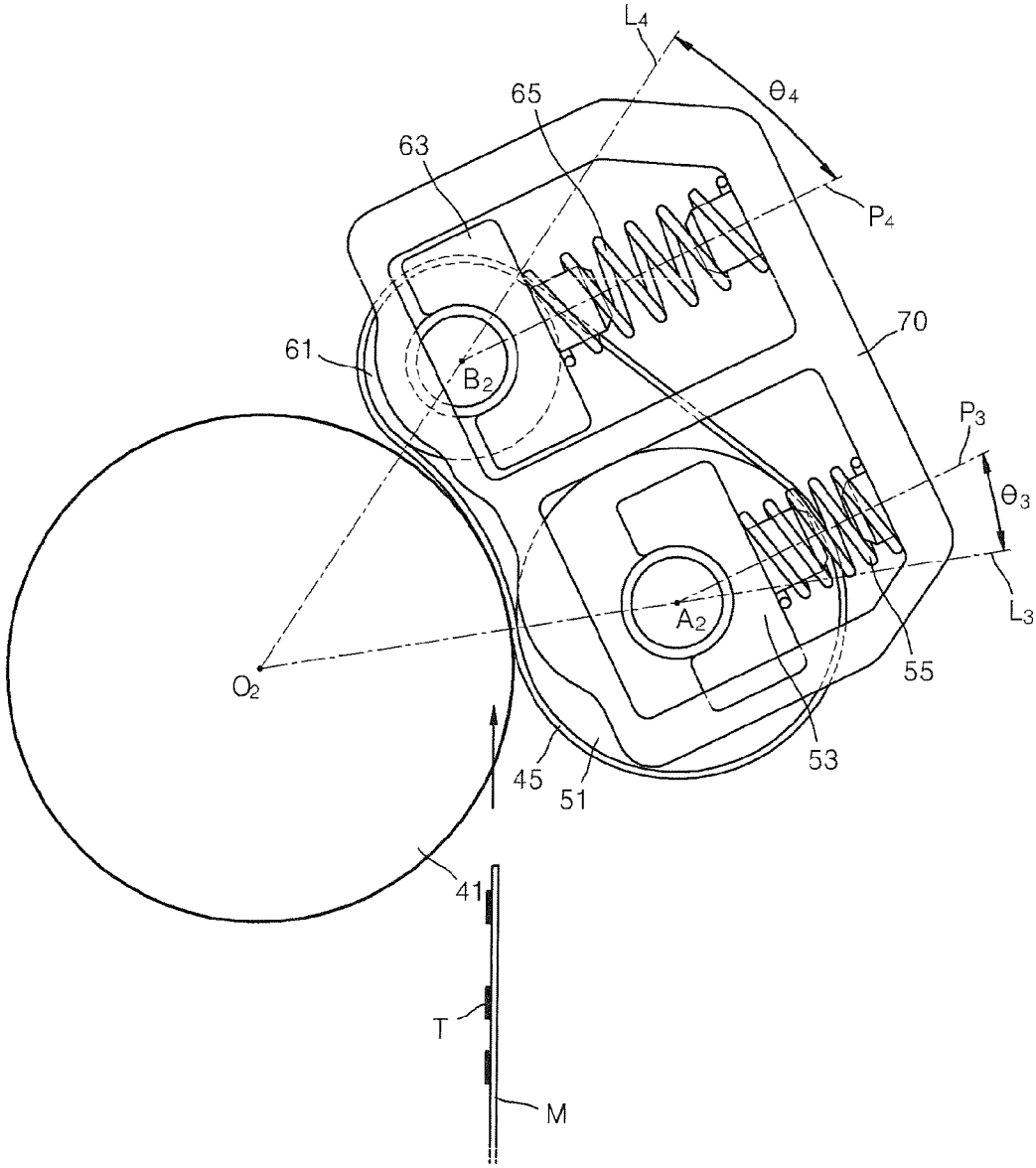
FIG. 2 is a schematic cross-sectional view of a fusing device according to an embodiment of the present invention.
Figure 3:
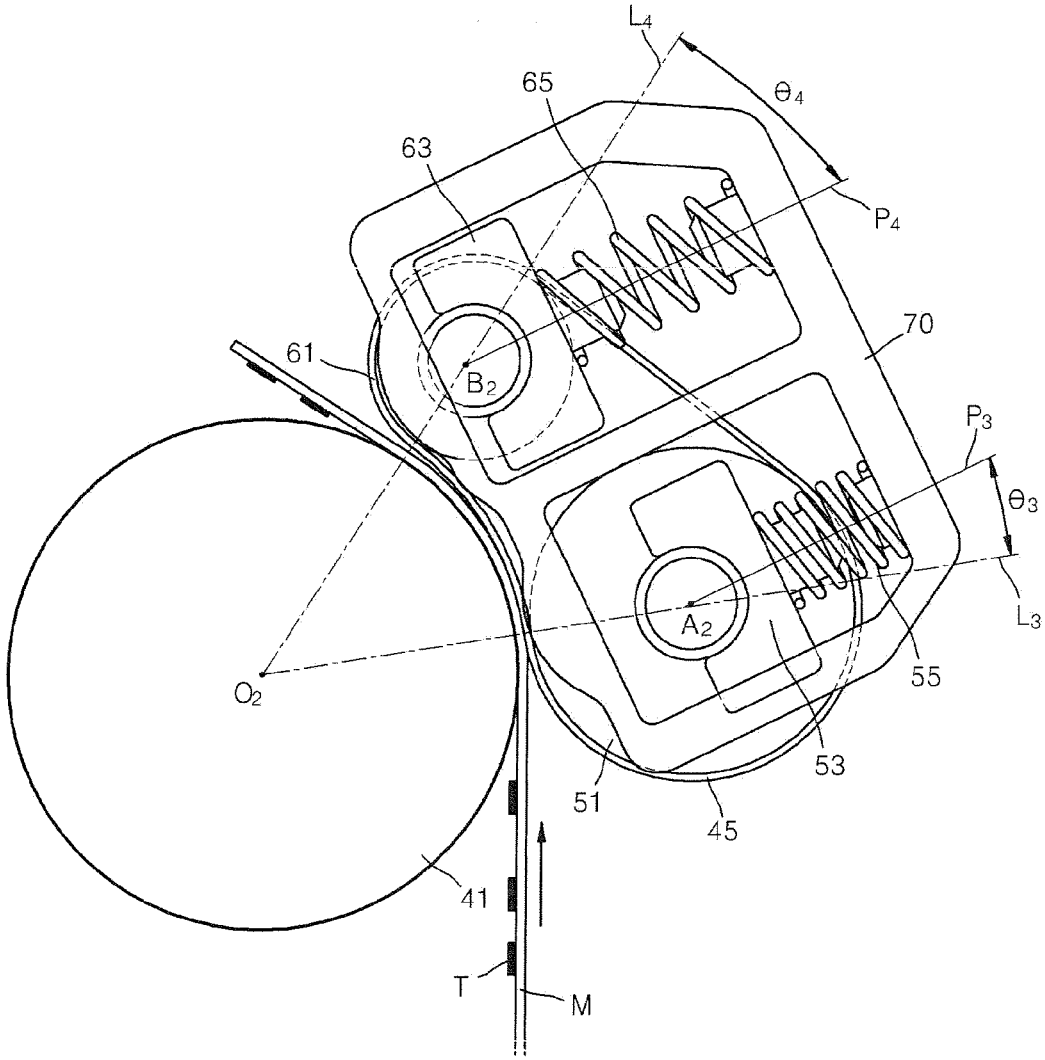
FIG. 3 illustrates an operation of the fusing device according to an embodiment of the present invention.

FIG. 2 is a schematic cross-sectional view of a fusing device according to an embodiment of the present invention. FIG. 3 illustrates an operation of the fusing device according to an embodiment of the present invention. Referring to FIGS. 2 and 3, the fusing device according to an embodiment of the present invention is provided to fuse an unfused toner image T formed on a print medium M. The fusing device includes a heating roller 41 that is heated by a heat source provided therein. A pressure roller 51 and a separation roller 61 both face the heating roller 41. A fusing pressure belt 45 winds around the pressure roller 51 and the separation roller 61. A first elastic member 55 elastically pressures the pressure roller 51 toward the heating roller 41. A second elastic member 65 elastically pressures the separation roller 61 toward the heating roller 41.

The pressure roller 51 and the separation roller 61 support the fusing pressure belt 45 such that the fusing pressure belt 45 is rotatable around the pressure roller 51 and the separation roller 61. Furthermore, the pressure roller 51 and the separation roller 61 allow a portion of the fusing pressure belt 45 to be in contact with the heating roller 41 or a print medium M being fed. Here, a toner image T transferred on the print medium M is fused on the print medium M by heating and pressing through the fusing device. The pressure roller 51 presses the print medium M that is provided (or fed through), along with the heating roller 41. The separation roller 61 separates the print medium M that is completely settled from the fusing device.

The fusing pressure belt 45 rotatably winds around the pressure roller 51 and the separation roller 61 and forms a fusing nip in contact with the heating roller 41.

The first elastic member 55 supports the pressure roller 51 to be elastically pressured along a first line $P_3$ and/or the second elastic member 65 supports the separation roller 61 to be elastically pressured along a third line $P_4$. It is understood that according to other aspects, methods other than elastic pressure and devices other than an elastic member may be used to pressure the pressure roller 51 and the separation roller 61. Here, the first line $P_3$ is a line that goes through the center $A_2$ of the pressure roller 51 and makes a predetermined angle $\theta_3$ with a second line $L_3$ towards the separation roller 61 (i.e., the first line $P_3$ is closer to the separation roller 61 than the second line $L_3$). The second line $L_3$ is a line that goes through the center $O_2$ of the heating roller 41 and the center $A_2$ of the pressure roller 51. For example, the angle of $\theta_3$ formed by the first line $P_3$ and the second line $L_3$ may, although not necessarily, satisfy a range according to the following equation 1:

$$7 \leqq \theta_3 \leqq 13[°] \quad \text{[Equation 1]}$$

To this end, the first elastic member 55 is interposed between a first bushing 53 that supports the pressure roller 51 to be rotatable and a frame 70 in order to elastically pressure the pressure roller 51 along the first line $P_3$.

The parameters of the non-limiting example equation 1 are provided to prevent the fusing pressure belt 45 from slipping due to tension of the fusing pressure belt 45 that is maintained insufficiently. It is understood that according to other aspects, parameters other than 7° and 13° may be used. If the angle θ3 is less than the minimum value in the equation 1, a variation of a distance between a center A2 of the pressure roller 51 and a center B2 of the separation roller 61 becomes large when the fusing device fuses a print medium M of about 1 mm or more thick. Thus, the tension of the fusing pressure belt 45 increases and the fusing pressure belt 45 may become deformed or slip, thereby causing an image distortion, an image offset, a print medium M jam, and the like. If the angle θ3 is greater than the maximum value in the equation 1, the center A2 of the pressure roller 51 inclines to the center B2 of the separation roller 61 too much. Thus, the tension of the fusing pressure belt 45 decreases and the fusing pressure belt 45 may slip.

The third line $P_4$ is a line that goes through the center $B_2$ of the separation roller 61 and makes a predetermined angle $\theta_4$ with a fourth line $L_4$ towards the pressure roller 51 (i.e., the third line $P_4$ is closer to the pressure roller 51 than the fourth line $L_4$). The fourth line $L_4$ is a line that goes through the center $O_2$ of the heating roller 41 and the center $B_2$ of the separation roller 61. For example, the angle of $\theta_4$ formed by the third line $P_4$ and the fourth line $L_4$ may, although not necessarily, satisfy a range according to the following equation 2:

$$7 \leqq \theta_4 \leqq 13[°] \quad \text{[Equation 2]}$$

To this end, the second elastic member 65 is interposed between a second bushing 63 that supports the separation roller 61 to be rotatable and the frame 70 in order to elastically pressure the separation roller 61 along the third line $P_4$.

The parameters of the non-limiting example equations 1 and 2 are provided to prevent the fusing pressure belt 45 from slipping due to tension of the fusing pressure belt 45 that is maintained insufficiently. It is understood that according to other aspects, parameters other than 7° and 13° may be used. If the angles $\theta_3$ and $\theta_4$ are less than the minimum values in the equations 1 and 2, a variation of the distance between the center $A_2$ of the pressure roller 51 and the center $B_2$ of the separation roller 61 becomes large when the fusing device fuses a print medium M of about 1 mm or more thick. Thus, the tension of the fusing pressure belt 45 increases and the fusing pressure belt 45 may become deformed or slip, thereby causing an image distortion, an image offset, a print medium M jam, and the like. Also, if the angle $\theta_3$ and $\theta_4$ are greater than the maximum values in the equations 1 and 2, the distance between the center $A_2$ of the pressure roller 51 decreases when the fusing device fuses the print medium M of about 1 mm or more thick. Thus, the tension of the fusing pressure belt 45 decreases and the fusing pressure belt 45 may slip.

According to an aspect of the present invention, the first and the third lines $P_3$ and $P_4$ are parallel to each other. Specifically, the first and the third lines $P_3$ and $P_4$ satisfying, for example, the conditions of the equations 1 and 2 are parallel to each other. In this case, if the pressure roller 51 and the separation roller 61 move farther away from the heating roller 41 as, for example, the thickness of the print medium M changes or a plurality of sheets of print media M pass through, the distance between the center $A_2$ of the pressure roller 51 and the center $B_2$ Of the separation roller 61 does not change. Thus, the fusing pressure belt 45 may not slip or be deformed. While shown as parallel, it is understood that lines $P_3$ and $P_4$ need not be exactly parallel in all aspects, and that the lines $P_3$ and $P_4$ can be non-parallel in other aspects.

As described above, the pressure roller 51 and the separation roller 61 are designed to be elastically pressured in a direction of the first line $P_3$ and in a direction of the third line $P_4$, respectively. As a result, the pressure roller 51 and the separation roller 61 are elastically pressured as the print medium M being fed between the heating roller 41 and the fusing pressure belt 45 changes in thickness (as illustrated in FIG. 3). The variation of the distance between the center $A_2$ of the pressure roller 51 and the center $B_2$ of the separation roller 61 does not significantly change as compared to that in the conventional fusing device of FIG. 1. That is, the variation of the distance is hardly influenced by a thickness variation of the print medium M, and thus a pressure applied to the fusing pressure belt 45 does not significantly change. Accordingly, the fusing pressure belt 45 may be prevented from slipping or being deformed, thereby preventing an image distortion, an image offset, a printing medium jam, and the like.

Figure 4:
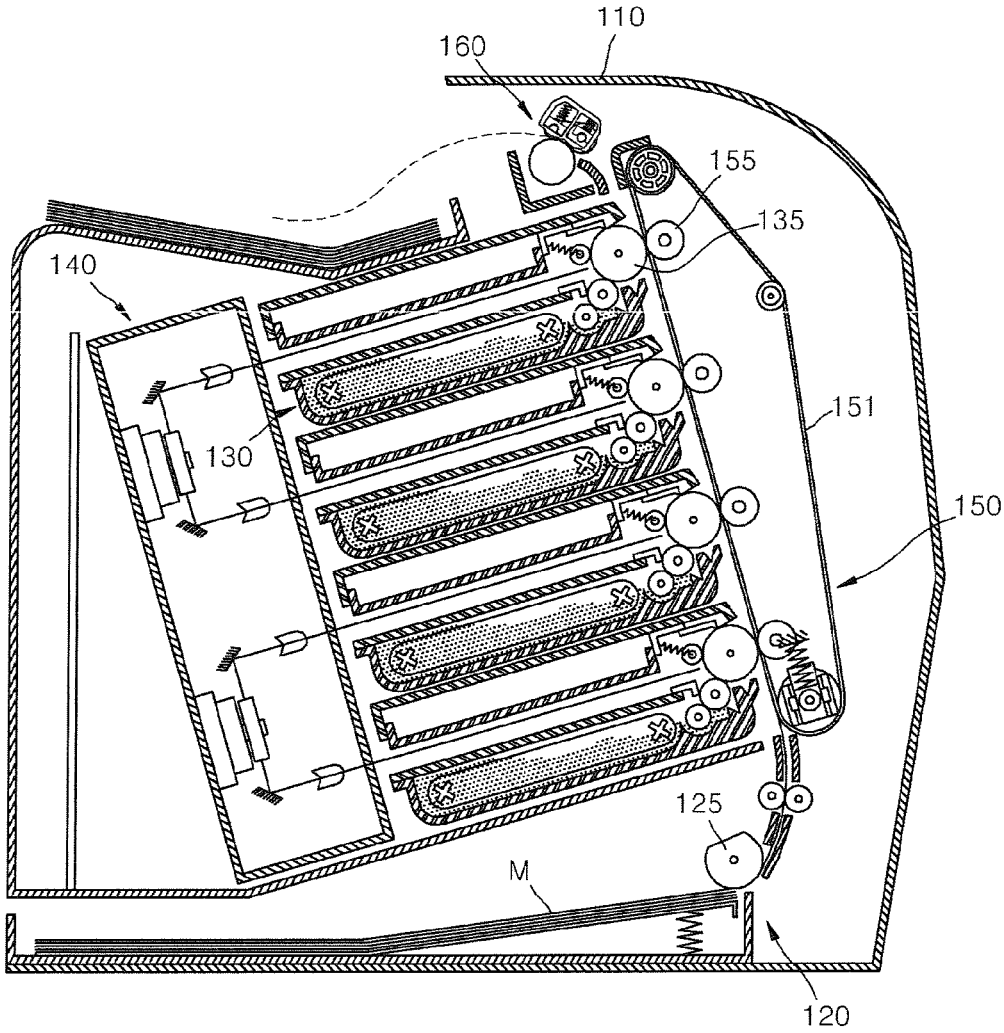
FIG. 4 is a schematic cross-sectional view of an image forming apparatus employing the fusing device according to an embodiment of the present invention.

FIG. 4 is a schematic cross-sectional view of an image forming apparatus according to an embodiment of the present invention. Referring to FIG. 4, the image forming apparatus is provided as a tandem type color image forming apparatus and includes a cabinet 110, a developing unit 130 mounted in the cabinet 110, a light scanning unit 140, a transfer unit 150, and a fusing device 160. However, it is understood that according to other aspects, the image forming apparatus need not be a tandem type image forming apparatus and can be a non-color apparatus. Moreover, the apparatus can be a multifunction device in other aspects including functions of copying, faxing, and/or scanning.

The cabinet 110 forms an external shape of the image forming apparatus and includes a supplying unit 120 that contains print media and is detachable therefrom. A print medium M in the supplying unit 120 is picked up by a pickup roller 125 and transferred through a transferring passage between the developing unit 130 and the transfer unit 150.

The developing unit 130 includes a photosensitive medium 135 on which an electrostatic latent image formed responding to a beam from the light scanning unit 140. The developing unit 130 develops the image on the photosensitive medium 135 with a toner provided in the developing unit 130 to form a toner image on the photosensitive medium 135.

According to an aspect of the present invention, the developing unit 130 is a single pass type. A plurality of developing units 130 may be provided such that each of the developing units 130 corresponds to a color in order to form a full color image. As shown in FIG. 4, for example, the developing unit 130 includes four units to display yellow, magenta, cyan, and black. However, it is understood that other colors and numbers of colors can be used in other aspects, and that only a single unit 130 need be used in a mono-color embodiment.

The light scanning unit 140 scans a beam to form an electrostatic latent image on each of a plurality of photosensitive mediums 135. To this end, the light scanning unit 140 has a multi-beam light scanning structure to scan a beam to the plurality of photosensitive mediums 135 at the same time. The light scanning unit 140 includes a beam deflector (not labeled) to deflectively scan a beam irradiated from a light source (not shown). The light scanning unit 140 further includes an f-θlens (not labeled) to scan an image light deflected by the beam deflector on a surface to be scanned. Here, the light source may include a semiconductor element with a plurality of luminous points or a single luminous point corresponding to each color, but is not restricted thereto.

The transfer unit 150 is provided to face the photosensitive medium 135 with the print medium M being transferred through the transferring passage interposed therebetween such that the transfer unit 150 transfers a toner image formed on the photosensitive medium 135 to the print medium M. Thus, the transfer unit 150 includes a transfer belt 151 that faces the photosensitive medium 135 and a transfer backup roller 155. An image transferred by the transfer unit 150 to the print medium M is fused by the fusing device 160.

The fusing device 160 includes the heating roller 41, the pressure roller 51, the separation roller 61, the fusing pressure belt 45, and the elastic members 55, 65. The fusing device 160 fuses an unfused toner image transferred to the print medium M by pressing the heating roller 41 and the fusing pressure belt 45, which is also pressured by the pressure roller 51. A configuration and an operation of the fusing device 160 is substantially the same as that described with reference to FIGS. 2 and 3, and thus descriptions thereof will not be repeated.

It is understood that aspects of the present invention may be applied to other components of an image forming apparatus. That is, other rollers that have a single belt that winds around them may also be provided according to aspects of the present invention, such that when the other rollers move farther away from a unit on which the belt forms a nip with, the distance between the other rollers does not vary significantly.

As described above, in the fusing device according to aspects of the present invention and the image forming apparatus employing the same, as the pressure roller and the separation roller move farther away from the heating roller according to a thickness variation of the printing medium, the distance between the center of the pressure roller and the center of the separation roller does not significantly change. Thus, as a variation of a pressure applied to the fusing pressure belt is insignificant, the fusing pressure belt is prevented from slipping or being deformed, thereby preventing an image distortion, an image offset, a printing medium jam, and the like. Furthermore, the image forming apparatus according to aspects of the present invention provides a consistent fusing performance by employing the aforementioned fusing device, thereby improving a printing quality.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing device that is provided on a printing passage of an image forming apparatus and fuses an image transferred to a print medium, the fusing device comprising:

a heating roller;

a pressure roller facing the heating roller to press the print medium fed along the printing passage against the heating roller;

a separation roller facing the heating roller to separate the print medium from the heating roller after the image is fused on to the print medium;

a fusing pressure belt that winds around the pressure roller and the separation roller and forms a fusing nip to contact with the heating roller;

a first pressure member to pressure the pressure roller towards the heating roller along a first line; and a second pressure member to pressure the separation roller towards the heating roller, wherein the first line passes through a center of the pressure roller and forms an angle $\theta_1$ towards the separation roller with a second line that passes through a center of the heating roller and the center of the pressure roller.

2. The fusing device as claimed in claim 1, wherein the angle $\theta_1$ formed by the first line and the second line satisfies an equation 1:

$$7° \leqq \theta_1 \leqq 13°. \quad \text{Equation 1}$$

3. The fusing device as claimed in claim 1, wherein:

the second pressure member pressures the separation roller towards the heating roller along a third line, and the third line passes through a center of the separation roller and forms an angle $\theta_2$ towards the pressure roller with a fourth line that passes through the center of the heating roller and the center of the separation roller.

4. The fusing device as claimed in claim 3, wherein the angle $\theta_2$ formed by the third line and the fourth line satisfies an equation 2:

$$7° \leqq \theta_2 \leqq 13°. \quad \text{Equation 2}$$

5. The fusing device as claimed in claim 3, wherein the first line and the third line are substantially parallel with each other.

6. The fusing device as claimed in claim 1, wherein the fusing device further comprises:

a first bushing that supports the pressure roller to be rotatable;

a second bushing that supports the separation roller to be rotatable; and a frame such that the first pressure member is provided between the first bushing and the frame and the second pressure member is provided between the second bushing and the frame.

7. The fusing device as claimed in claim 1, wherein the first pressure member elastically pressures the pressure roller towards the heating roller.

8. The fusing device as claimed in claim 1, wherein the second pressure member elastically pressures the separation roller towards the heating roller.

9. An image forming apparatus comprising:

a developing unit to develop an image with a toner and form the image;

a light scanning unit to scan a beam to the developing unit to form an electrostatic latent image on the developing unit;

a transfer unit corresponding to the developing unit to transfer the latent image formed on the developing unit to a print medium; and the fusing device according to claim 1 that is provided on a printing passage and fuses the image transferred to the print medium.

10. The image forming apparatus as claimed in claim 9, wherein the angle $\theta_1$ formed by the first line and the second line satisfies an equation 1:

$$7° \leqq \theta_1 \leqq 13°. \quad \text{[Equation 1]}$$

11. The image forming apparatus as claimed in claim 9, wherein:

the second pressure member pressures the separation roller towards the heating roller along a third line, and the third line passes through a center of the separation roller and forms an angle $\theta_2$ towards the pressure roller with a fourth line that passes through the center of the heating roller and the center of the separation roller.

12. The image forming apparatus as claimed in claim 11, wherein the angle $\theta_2$ formed by the third line and the fourth line satisfies an equation 2:

$$7° \leqq \theta_2 \leqq 13°. \quad \text{[Equation 2]}$$

13. The image forming apparatus as claimed in claim 9, wherein the fusing device further comprises:

a first bushing that supports the pressure roller to be rotatable;

a second bushing that supports the separation roller to be rotatable; and a frame such that the first pressure member is provided between the first bushing and the frame and the second pressure member is provided between the second bushing and the frame.

14. A fusing device that is provided on a printing passage of an image forming apparatus and fuses an image transferred to a print medium, the fusing device comprising:

a heating roller;

a pressure roller facing the heating roller to press the print medium fed along the printing passage against the heating roller;

a separation roller facing the heating roller to separate the print medium from the heating roller after the image is fused on to the print medium;

a fusing pressure belt that winds around the pressure roller and the separation roller and forms a fusing nip to contact with the heating roller;

a first pressure member to pressure the pressure roller towards the heating roller; and a second pressure member to pressure the separation roller towards the heating roller along a first line, wherein the first line passes through a center of the separation roller and forms an angle $\theta_1$ towards the pressure roller with a second line that passes through a center of the heating roller and the center of the separation roller.

15. The fusing device as claimed in claim 14, wherein the angle $\theta_1$ formed by the first line and the second line satisfies an equation 1:

$$7° \leqq \theta_1 \leqq 13°. \quad \text{[Equation 1]}$$

16. The fusing device as claimed in claim 14, wherein the fusing device further comprises:

a first bushing that supports the pressure roller to be rotatable;

a second bushing that supports the separation roller to be rotatable; and a frame such that the first pressure member is provided between the first bushing and the frame, and the second pressure member is provided between the second bushing and the frame.

17. The fusing device as claimed in claim 14, wherein the first pressure member elastically pressures the pressure roller towards the heating roller and the second pressure member elastically pressures the separation roller towards the heating roller.

18. A pressing device that is provided in an image forming apparatus, the pressing device comprising:

a common roller;

a first roller facing the common roller;

a second roller facing the common roller;

a pressure belt that winds around the first roller and the second roller and forms a nip to contact with the common roller so as to fix an image on a medium passing between the pressure belt and the common roller;

a first pressure member to pressure the first roller towards the common roller along a first line; and a second pressure member to pressure the second roller towards the common roller along a second line, the first line being substantially parallel with the second line.

19. A fusing device that is provided on a printing passage of an image forming apparatus and fuses an image transferred to a print medium, the fusing device comprising:

a heating roller;

a pressure roller facing the heating roller to press the print medium fed along the printing passage against the heating roller;

a separation roller facing the heating roller to separate the print medium from the heating roller after the image is fused on to the print medium;

a fusing pressure belt that winds around the pressure roller and the separation roller and forms a fusing nip to contact with the heating roller;

a first pressure member to pressure the pressure roller towards the heating roller along a first line; and a second pressure member to pressure the separation roller towards the heating roller along a second line, the second line being substantially parallel with the first line.

20. A method of fusing an image transferred to a print medium in an image forming apparatus, the method comprising:

forming a fusing nip to contact a heating roller with a fusing pressure belt that winds around a pressure roller and a separation roller;

pressuring the pressure roller along a first line towards the heating roller in order to press the print medium against the heating roller; and pressuring the separation roller along a second line towards the heating roller in order to separate the print medium from the heating roller, wherein the first line and the second line are roughly parallel with each other.

* * * * *